US006387020B1

(12) United States Patent
Simonson

(10) Patent No.: US 6,387,020 B1
(45) Date of Patent: May 14, 2002

(54) EXERCISE APPARATUS

(76) Inventor: Roy Simonson, 727 Bear Paw La., Colorado Springs, CO (US) 80906

( * ) Notice: Subject to any disclaimer, the term of this patent is extended or adjusted under 35 U.S.C. 154(b) by 0 days.

(21) Appl. No.: 09/379,307

(22) Filed: Aug. 23, 1999

(51) Int. Cl.[7] ..... A63B 21/06
(52) U.S. Cl. ..... 482/99; 482/102
(58) Field of Search ..... 482/94, 98, 99, 482/102, 103, 133, 138, 139

(56) References Cited

U.S. PATENT DOCUMENTS

| | | | | |
|---|---|---|---|---|
| 353,089 | A | 11/1886 | Smith | |
| 457,400 | A | 8/1891 | Dowd | |
| 1,928,089 | A | 9/1933 | Blickman | |
| 2,436,987 | A | 3/1948 | Bailleaux | |
| 2,977,120 | A | 3/1961 | Morris | |
| 4,603,855 | A | 8/1986 | Sebelle | |
| 4,635,926 | A * | 1/1987 | Minkow | 482/102 |
| 4,826,157 | A | 5/1989 | Fitzpatrick | |
| 4,907,798 | A | 3/1990 | Burchatz | |
| 4,974,838 | A | 12/1990 | Sollenberger | |
| 5,267,930 | A * | 12/1993 | Henes | 482/102 |
| 5,738,616 | A | 4/1998 | Robertson | |

OTHER PUBLICATIONS

Cybek "Modular" Brochure @ 1994.*

* cited by examiner

*Primary Examiner*—John Mulcahy
(74) *Attorney, Agent, or Firm*—Workman Nydegger & Seeley

(57) ABSTRACT

A family of exercise apparatuses designed to target a variety of muscle groups is disclosed. The family includes a variety of distinct exercise apparatuses utilizing a substantially identical base structure. The base structure comprises a central support member having a first end to which a user support structure is secured and a second end to which a weight stack is secured, wherein the weight stack is actuated by a cable secured thereto for movement by an individual using a distinct exercise apparatus. In addition, each distinct exercise apparatus further includes first and second lateral support sleeves secured to the base structure for directing opposite strands of the cable to a predetermined position for engagement by a user. An exercise apparatus and a method for manufacturing exercise apparatuses are disclosed.

Other objects and advantages of the present invention will become apparent from the following detailed description when viewed in conjunction with the accompanying drawings, which set forth certain embodiments of the invention.

22 Claims, 15 Drawing Sheets

EXERCISE APPARATUS

BACKGROUND OF THE INVENTION

1. Field of the Invention

The invention relates to a family of exercise apparatuses. More particularly, the invention relates to a family of exercise apparatuses built upon a substantially identical base structure allowing users to move in a wide range of motions from a single support position.

2. Description of the Prior Art

Exercise apparatuses providing an integrally formed user support with an adjacent weight stack have been around for some time. As these apparatuses have developed, their specific uses have become highly specialized. This specialization has developed to the point where current exercise apparatuses are designed to exercise specific muscle groups by moving an individual's limbs through a highly controlled motion.

While these prior art exercise apparatuses are effective in developing specifically targeted muscle groups, they do not provide individuals with the versatility required to easily vary the targeted muscle groups. For example, where an individual wishes to work his or her biceps, repetitive motion along a highly controlled path will target a specific portion of an individual's biceps while also less effectively targeting adjacent portions of the individual's biceps. With this in mind, the controlled nature of such exercise apparatuses prevents the individual from slightly varying his or her exercising motion to effectively target the wide range of muscles making up the individual's biceps.

Similarly, conventional chest exercise apparatuses provide a bench upon which a user lies while he or she pushes upwardly against the resistance of a weight stack. Whether the weight stack is attached via cables with handles on the ends thereof or a rigid bar engaged by both hands at the same time, these exercise apparatuses require that a user sit or lay on the support surface in a somewhat precise position while engaging the handles or bar. As with the prior exercise apparatuses discussed throughout the Background of the Invention, prior chest exercise apparatuses limit variations in the exercises which may be performed, and thereby limit an individual's ability to target specific related muscles while using the same exercise apparatus.

The controlled nature of current exercise apparatuses is readily overcome by using free weights. However, free weights fail to offer many of the conveniences offered by stationary exercise apparatuses. For example, free weights are far less controlled, often requiring a partner for spotting and requiring substantial effort to vary the effort level when compared to the use of integral exercise apparatuses.

With the foregoing in mind, a need exists for a highly versatile, integral exercise apparatus. The exercise apparatus must provide the user with the possibility for a wide range of motions from a single support bench, while maintaining many of the conveniences offered by conventional exercise apparatuses. The present invention provides such an exercise apparatus. In fact, the present invention provides a variety of exercise apparatuses offering desirable flexibility with the convenience of an integral exercise apparatus.

In addition, and as briefly discussed above, a variety of exercise apparatuses have been designed for targeting specific muscle groups. In fact, if one were to visit his or her local gym, they would find specific apparatuses for targeting the triceps, biceps, lats, shoulders, abdominals, the chest, etc. They would also notice multipurpose apparatuses simulating common motions, for example, rowing motions, pull-up machines and dip machines.

Prior designers have been required to start from scratch, or close to scratch, when developing a new exercise apparatus targeting a specific body part. The necessity for varying the apparatus design adds substantial cost to the development process. The additional cost may result in fewer new exercise apparatuses reaching the market or increased cost being passed on to consumers. A need, therefore, also exists for a novel structure to be implemented in the development of a family of exercise apparatuses. The structure must provide manufacturers with the ability to design new apparatuses around a single base structure without requiring substantial variation of the base structure to implement the modifications required for targeting different muscles groups. The present invention provides such a structure as well as a system for implementing the structure in the development of a family of exercise apparatuses.

SUMMARY OF THE INVENTION

It is, therefore, an object of the present invention to provide a family of exercise apparatuses designed to target a variety of muscle groups. The family includes a variety of distinct exercise apparatuses utilizing a substantially identical base structure. The base structure comprises a central support member having a first end to which a user support structure is secured and a second end to which a weight stack is secured, wherein the weight stack is actuated by a cable secured thereto for movement by an individual using a distinct exercise apparatus. In addition, each distinct exercise apparatus further includes first and second lateral support sleeves secured to the base structure for directing opposite strands of the cable to a predetermined position for engagement by a user.

It is also an object of the present invention to provide an exercise apparatus including a base structure having a central support member with a first end to which a user support structure is secured and a second end to which a weight stack is secured, wherein the weight stack is actuated by a cable secured thereto for movement by an individual using a distinct exercise apparatus. The exercise apparatus further includes first and second lateral support sleeves selectively secured to the base structure for directing opposite strands of the cable to a predetermined position for engagement by a user.

It is another object of the present invention to provide a method for manufacturing a family of exercise apparatuses designed to target a variety of muscle groups. The method is achieved by creating a base structure dimensioned for use in the development of a variety of distinct exercise apparatuses designed to target different muscle groups. The base structure includes a central support member having a first end to which a user support structure is secured and a second end to which a weight stack is secured, wherein the weight stack is actuated by a cable secured thereto for movement by an individual using a distinct exercise apparatus. The first and second lateral support sleeves are then selectively secured to the base structure at distinct positions for directing opposite strands of the cable to predetermined positions for engagement by a user to perform various exercises targeting different muscle groups.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
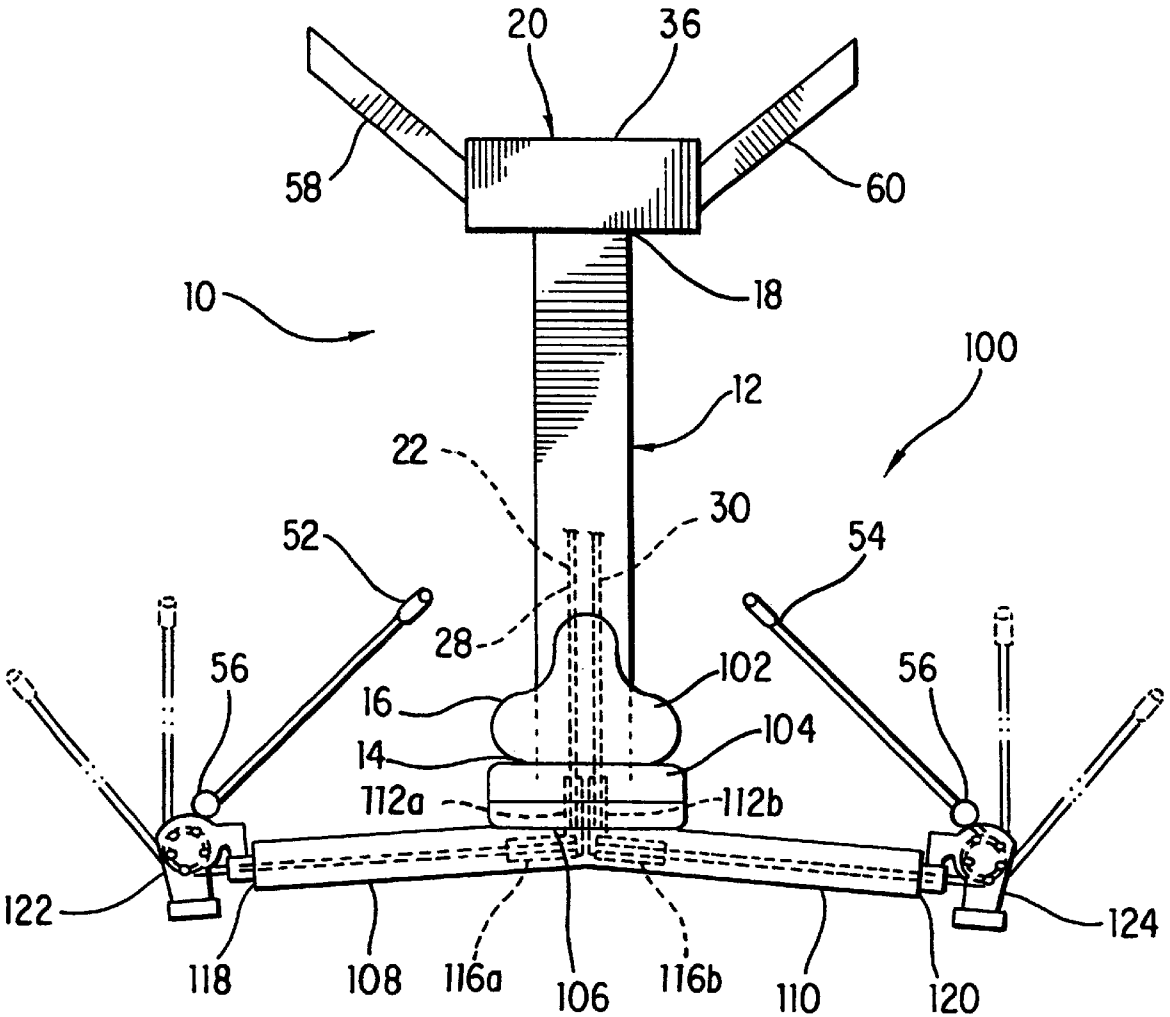
FIG. 1 is a top view of a chest exercise apparatus in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 to 23, a family of exercise apparatuses is disclosed. Each member of the family is adapted for targeting a specific body part, or parts. However, and as discussed above in the Background of the Invention, the various exercise apparatuses making up the present family each include a substantially identical base structure around which the various exercise apparatuses are designed and constructed.

Each exercise apparatus is constructed with a base structure 10 including a central support member 12 having a first end 14 to which a user support structure 16 is secured and a second end 18 to which a weight stack 20 is secured. A single cable 22 actuates the weight stack 20. The single cable 22 is secured to the weight stack 20 for movement by an individual using a distinct exercise apparatus. Each apparatus further includes first and second support sleeves selectively secured to the base structure 16 for directing first and second strands 28, 30 (i.e., opposite strands) of the cable 22 to a predetermined position for engagement by a user.

The central support member 12 is preferably a tubular member. The tubular construction of the central support member 12 permits designers to pass the opposite cable strands 28, 30 therethrough to facilitate the adaptation of the base structure 10 for targeting various body parts. As with all of the structural components used in the manufacture of the present family of exercise apparatuses, the central support member 12 is formed from steel, although those skilled in the art will appreciate the other materials which may be used in the construction of the disclosed exercise apparatuses without departing from the spirit of the present invention.

The weight stack 20 secured to the second end 18 of the central support member 12 is a generally conventional weight stack and includes vertical support members 32 aligning to support a stack of weight plates 34 to be moved via a pulley system which will be discussed below in greater detail. The weight stack 20 is covered by a protective sleeve 36 positioned about the weight stack 20.

As will be discussed below in substantially greater detail, the weight stack 20 is actuated by a single cable 22 which controls the movement of the weight stack 20. The central portion 38 of the cable 22 is passed through a first pulley 40. A coupling member 42 directly couples the stack of weight plates 34 to the first pulley 40 in a conventional manner. Opposite strands 28, 30 of the cable 22 then respectively extend over first and second upper pulleys 44, 46 before passing over first and second lower pulleys 48, 50. In the case of the rowing apparatus, lat apparatus and triceps apparatus, the cable 22 merely passes over the upper pulleys 44, 46 before being positioned for engagement by the user. A variation such as this does not limit the functionality of the present base structure 10, as the variation only requires bypassing the lower pulleys 48, 50 without modifying the base structure 10 itself. In addition, and as will become apparent from the following disclosure, the angular orientation of the various pulleys may be readily adjusted to accommodate the various apparatuses making up the present invention. In this way, the cable 22 may be readily oriented to suit the needs of specific apparatuses.

After passing over the first and second lower pulleys, the respective first and second strands 28, 30 of the cable 22 pass through the opening formed in the central support member and toward the first end 14 of the central support member 12. Once reaching the first end 14 of the central support member 12, the first and second strands 28, 30 of the cable exit the central support member 12 for positioning in accordance with the specific use for which the base structure 10 is being applied.

The respective ends 52, 54 of the first and second strands 28, 30 are each provided with stop members 56. As those skilled in the art will readily appreciate, the stop members 56 control motion of the single cable 22 to allow exercise by pulling the first strand 28 alone, the second strand 30 alone, or both strands at the same time.

First and second lateral support members are also secured to the second end 18 of the central support member 12. The lateral support members 58, 60 extend outwardly from the longitudinal axis of the central support member 12 and away from the first end 14 of the central support member 12. The combination of the cental support member 12, the first lateral support 58 and the second lateral support 60 create a tripod foundation structure. This foundation structure supports the remaining components of the present exercise apparatuses, as well as users of the present exercise apparatuses.

With a versatile base structure 10 as disclosed above, each specific family member is created by selectively mounting desired support sleeves at various locations along the base structure 10. In this way, various exercise apparatuses are created from a single base structure 10 by orienting support sleeves for access along general motion lines. Each of the family members is discussed in below in detail. The following disclosure is not intended to be exhaustive of the many exercise apparatuses which may be manufactured from the disclosed base structure 10, but merely as exemplary of the various apparatuses which may be fabricated in accordance with the present invention.

The provision of a base structure 10 which may be readily used in the manufacture of distinct exercise apparatuses facilitates a novel method for the manufacture of exercise apparatuses. Specifically, a family of exercise apparatuses designed to target a variety of muscle groups is manufactured by first creating a base structure 10 dimensioned for use in the development of a variety of distinct exercise apparatuses designed to target different muscle groups. The base structure 10 includes a central support member 12 having a first end 14 to which a user support structure 16 is secured and a second end 18 to which a weight stack 20 is secured, wherein the weight stack 20 is actuated by a single cable 22 secured thereto for movement by an individual using a distinct exercise apparatus. First and second lateral support sleeves are then secured to the base structure 10 at distinct positions. The first and second support sleeves direct opposite strands 52, 54 of the cable 22 to predetermined positions for engagement by a user to perform various exercises targeting different muscle groups.

Figure 3:
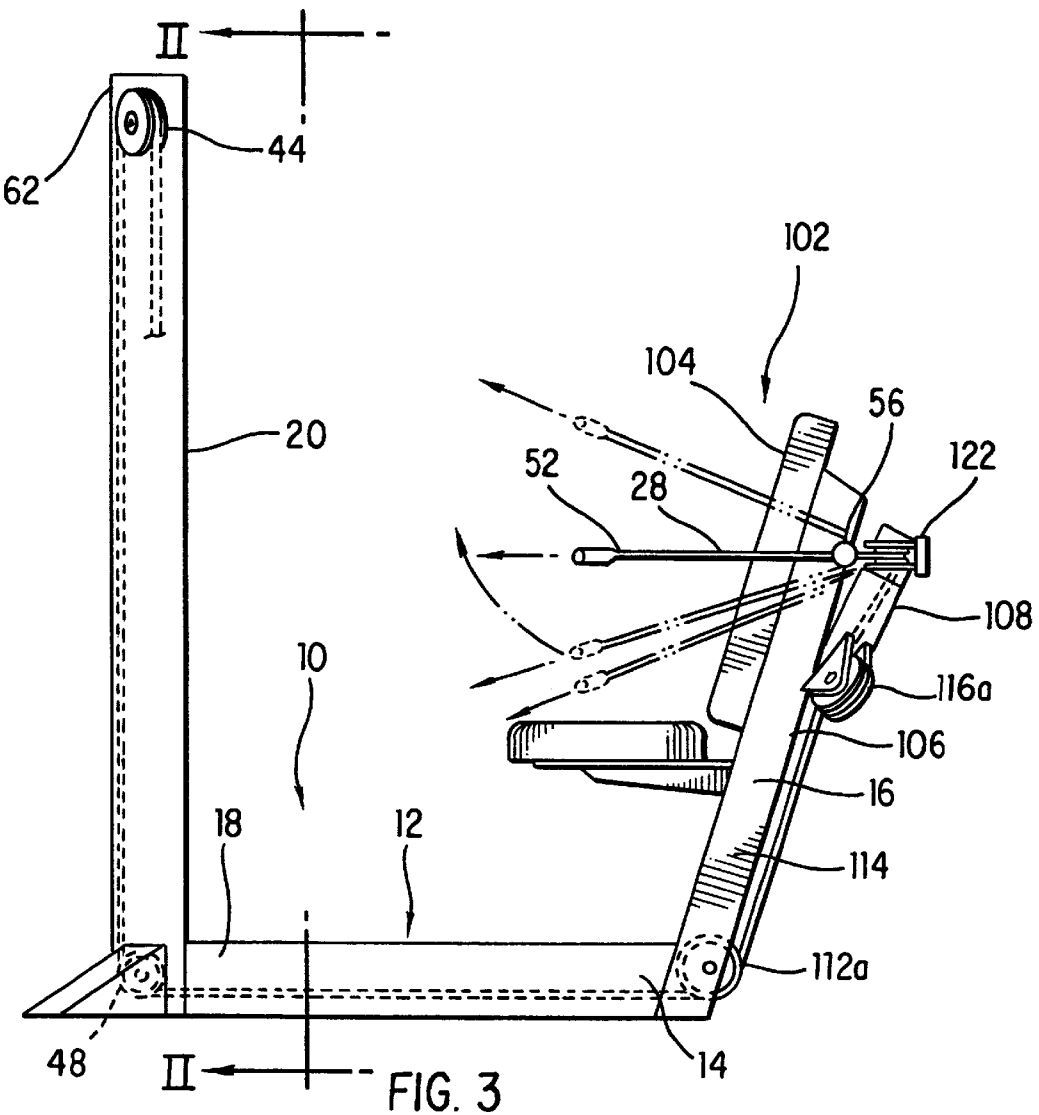
FIG. 3 is a side view of the chest exercise apparatus shown in FIG. 1.
Figure 2:
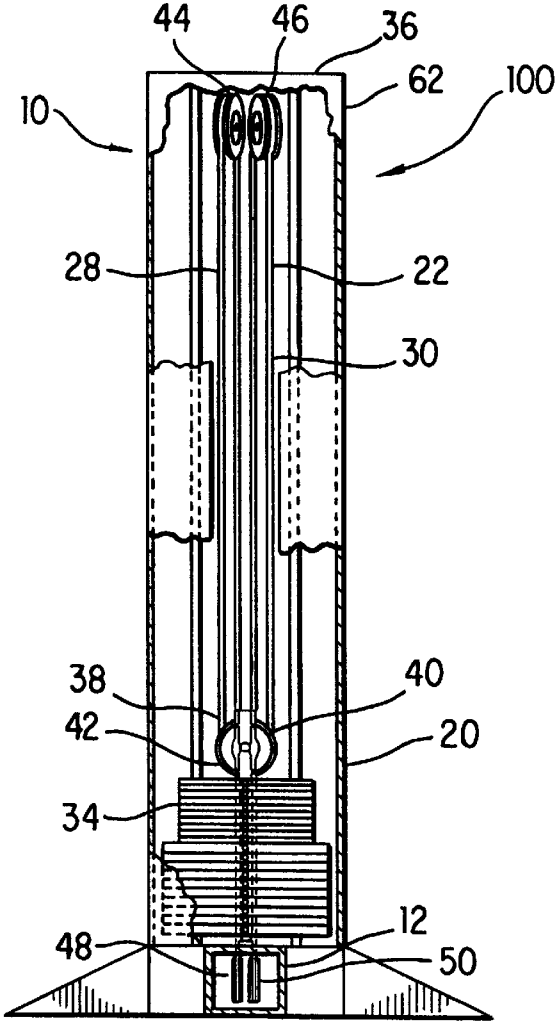
FIG. 2 is a cross sectional view of the chest exercise apparatus along the line II—II in FIG. 3.

With reference to FIGS. 1 to 3, a chest exercise apparatus 100 in accordance with the present invention is disclosed. The chest exercise apparatus 100 includes the base structure 10 discussed above. In order to accommodate the chest exercises being performed on the disclosed apparatus, the base structure 10, and specifically the user support structure 16, include a full seat 102 with an inclined backrest 104. The seat 102 is vertically adjustable to accommodate users of various sizes. While the present vertical adjustment mechanism is not critical to the invention disclosed in the present application, those skilled in the art will appreciate the variety of adjustment mechanism which may be used within the spirit of the present invention.

The backrest 104 is inclined at approximately an angle of 20°. While the specific orientation of the backrest 104 is considered ideal for the preferred embodiment of the present invention, it should be appreciated that the backrest 104 may be oriented at a variety of angles without departing from the spirit of the present invention. The backrest 104 provides the support necessary for performing chest exercises as an individual faces toward the weight stack 20 in accordance with the preferred embodiment of the present invention. While a specific seat structure is disclosed in accordance with the present invention, other seat structures may be employed without departing from the spirit of the present invention.

The single cable 22 coupled to the weight stack 20 extends from the weight stack 20 and through the center of the central support member 12 toward the first end 14 of the central support member 12. After exiting the first end 14 of the central support member 12, the respective strands 28, 30 of the cable 22 are guided along the back surface 106 of the support column 114 of seat 102 by a series of pulleys to first and second support sleeves 108, 110 extending from opposite sides of the backrest 104. Specifically, each strand 28, 30 of the cable respectively engages a parallel oriented pulley 112*a*, 112*b* positioned adjacent the first end 14 of the central support member 12. Each strand 28, 30 of the cable 22 then engages a transversely oriented pulley 116*a*, 116*b* positioned midway up the support column 114. The transversely oriented pulleys 116*a*, 116*b* direct the cable 22 into respective first and second support sleeves 108, 110.

The support sleeves 108, 110 extend upwardly and outwardly such that the distal end 118, 120 of each of the first and second support sleeves 108, 110 terminates at a position approximately in line with the top portion of the backrest 104 and the extended elbows of an individual using the present chest exercise apparatus 100. In accordance with the preferred embodiment of the present invention, the distal ends 118, 120 of the first and second support sleeves 108, 110 are positioned approximately 40 inches above the central support member 12 as the support sleeves 108, 110 respectively extend upwardly at an angle of 25° with respect to a horizontal plane and rearwardly at an angle of 5° with respect to a vertical plane.

First and second pivoting pulleys 122, 124 are respectively coupled to the distal ends 118, 120 of the first and second support sleeves 108, 110. In this way, the strands 28, 30 of the cable 22 respectively exit the first and second support sleeves 108, 110, pass over the pivoting pulleys 122, 124 and are ready for engagement by the user. The distal end 52, 54 of each strand 28, 30 of the cable 22 may be fitted with a wide variety of grips known to those skilled in the art.

Figure 4:
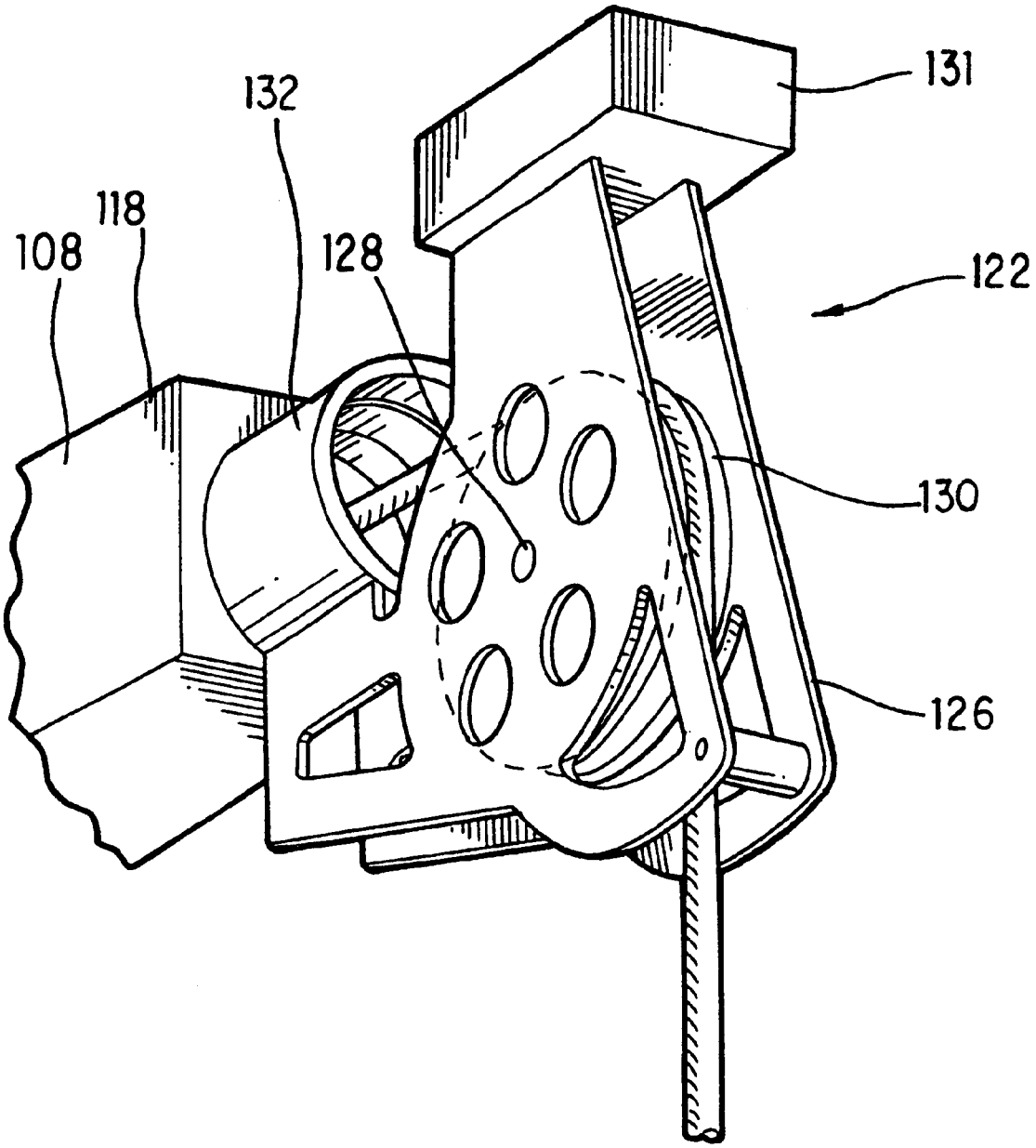
FIG. 4 is a perspective view of a pivoting pulley in accordance with the present invention.

The pivoting pulley 122, 124 is shown in greater detail in FIG. 4. Each pivoting pulley 122, 124 includes a frame 126 with a central pivot 128 for rotatably supporting a pulley member 130. The frame 126 is formed so as to cover the pulley member 130 and thereby prevent undesired access with the pulley member 130 as the cable 22 passes thereover. The frame 126 is further provided with a counterweight 131 opposite the pulley member 130. The frame 126 further includes a cylindrical coupling member 132 shaped and dimensioned for pivotal attachment to the distal end 118, 120 of a support sleeve 108, 110. The cylindrical coupling member 132 provides an opening through which the cable 22 passes as it extends from the support sleeve 108, 110 toward the pulley member 130. In this way, the cable 22 passes along the axis about which the pivoting pulley pivots 122,124 relative to the support sleeve 108, 110 to provide greater freedom of motion as an individual attempts to draw the cable 22 in various directions during exercise.

Since the pivoting pulley 122, 124 permits a great degree of flexibility with regard to the angle at which the cable 22 is drawn from the support sleeve 108, 110, the inclusion of the present pivoting pulleys 122, 124 at the distal end 118, 120 of each support sleeve 108, 110 greatly increases the flexibility of the present exercise apparatus.

In use, an individual is seated on the seat facing the weight stack. The individual will then grip the handles at the distal ends of the respective strands of the cable, and push the handles toward the weight stack to generate resistance from the weight stack. As shown in FIGS. 1 to 3, the flexibility provided by the pivoting pulleys permits the individual to move in a wide variety of paths in order to equally exercise a wide variety of chest muscles.

While it is disclosed above that the present chest exercise apparatus is designed to be used with the user sitting and facing the weight stack, the versatility provided by the design of the exercise apparatus provides users with virtually unlimited possibilities with regard to the range of exercise motions that may be accommodated by the present exercise apparatus.

Figure 5:
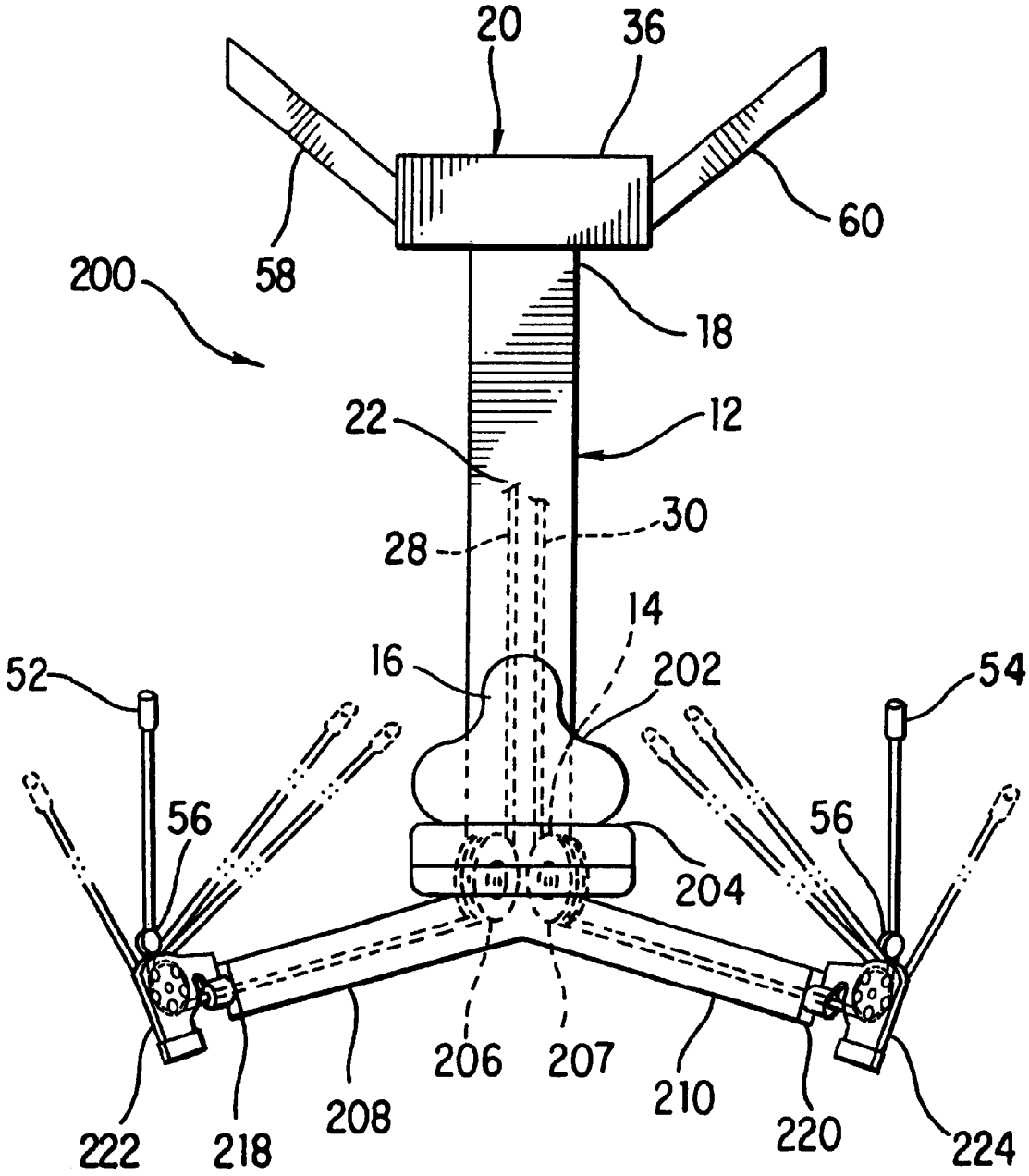
FIG. 5 is a top view of the shoulder exercise apparatus in accordance with the present invention.
Figure 7:
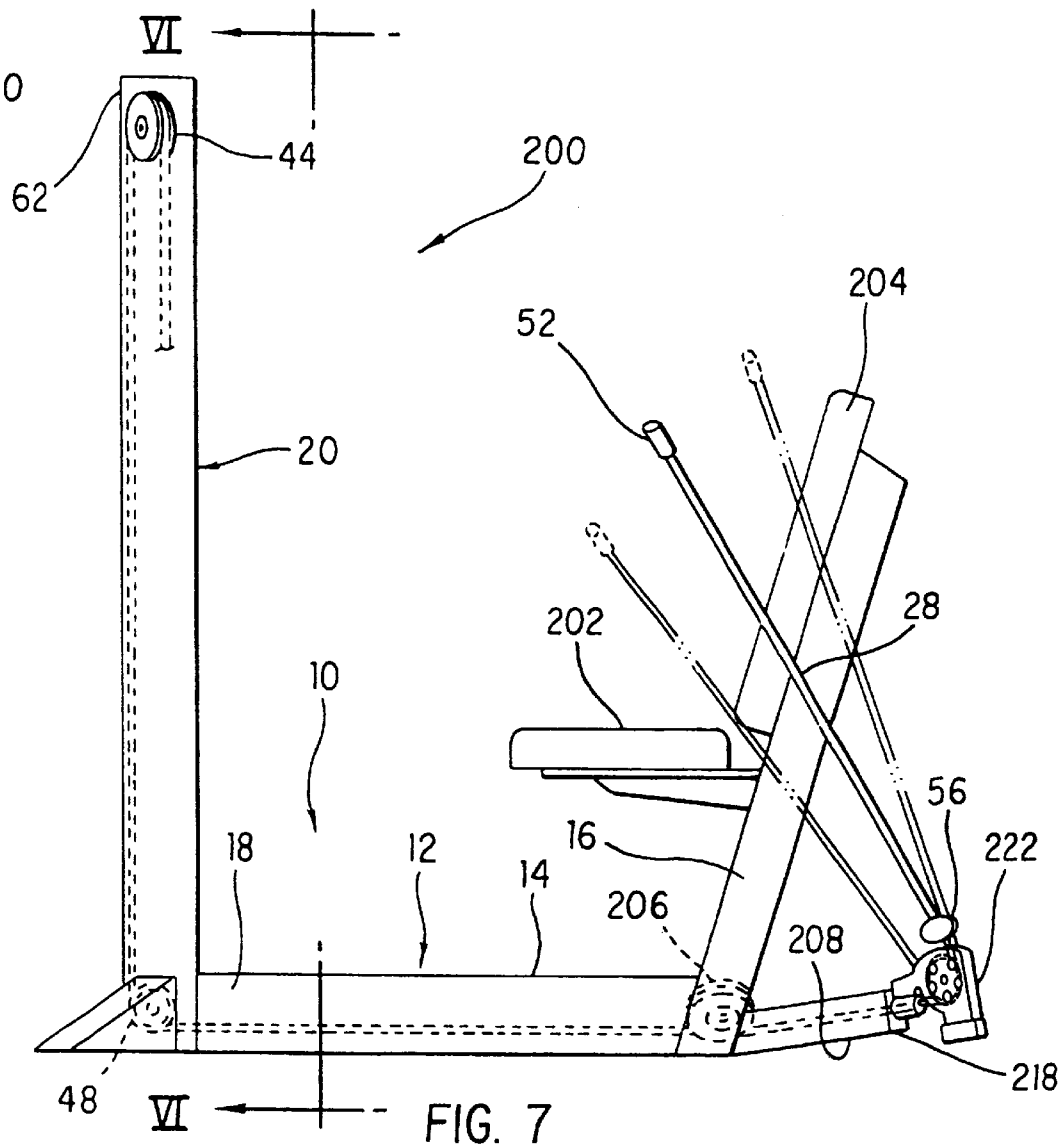
FIG. 7 is a side view of the shoulder exercise apparatus shown in FIG. 5.
Figure 6:
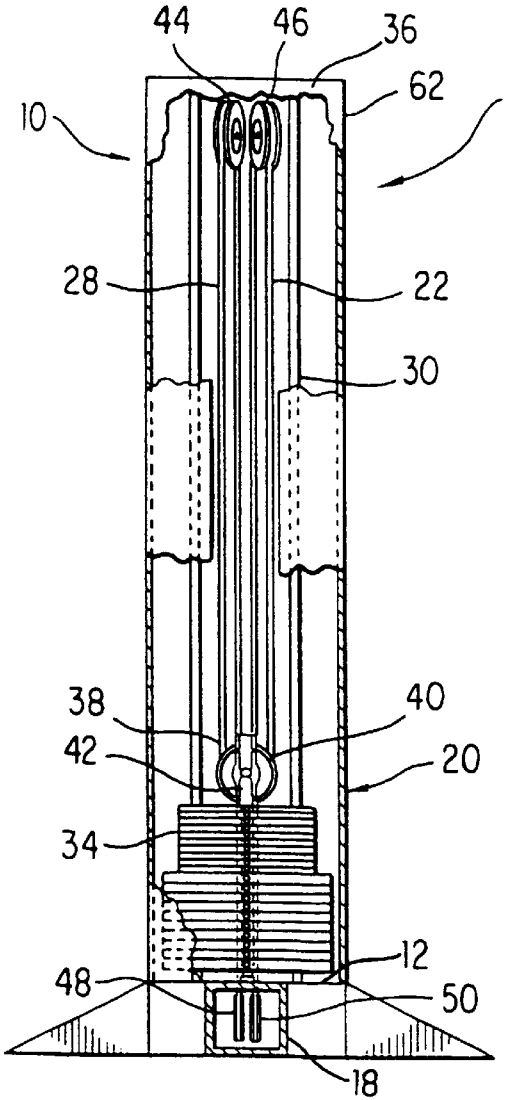
FIG. 6 is a cross sectional view of the shoulder exercise apparatus along the line VI—VI in FIG. 7.

With reference to FIGS. 5 to 7, a shoulder exercise apparatus 200 in accordance with the present invention is disclosed. The shoulder exercise apparatus 200 includes the base structure 10 discussed above. In order to accommodate the shoulder exercises being performed on the disclosed apparatus, the user support structure 16 includes a full seat 202 with an inclined backrest 204.

As with the chest exercise apparatus, the seat 202 is vertically adjustable and the backrest 204 provides support necessary for performing shoulder exercises as an individual faces toward the weight stack 20 in accordance with the preferred embodiment of the present invention. While a specific seat 202 structure is disclosed in accordance with the present invention, other seat structures may be employed without departing from the spirit of the present invention.

The single cable 22 coupled to the weight stack 20 discussed above extends from the weight stack 20 and through the center of the central support member 12 toward the first end 14 of the central support member 12. After exiting the first end 14 of the central support member 12, the respective strands 28, 30 of the cable 22 are directed by respective pulleys 206, 207 to enter first and second support sleeves 208, 210 secured to the first end 14 of the central support member 12. The support sleeves 208, 210 extend slightly upwardly and outwardly such that the distal end 218, 220 of each of the first and second support sleeves 208, 210 terminates at a position approximately aligned with the shoulder position of an individual who might be utilizing the present shoulder exercise apparatus 200.

Specifically, and in accordance with the preferred embodiment of the present invention, the distal end 218, 220 of each support sleeve 208, 210 is positioned approximately 7 inches above the central support member 12 as the support sleeves 208, 210 respectively extend upwardly at an angle of 10° relative to a horizontal plane and rearwardly at an angle of 7° relative to a vertical plane.

First and second pivoting pulleys 222, 224 are respectively coupled to the distal ends 218, 220 of the first and second support sleeves 208, 210. In this way, the strands 28, 30 of the cable 22 respectively exit the first and second support sleeves 208, 210, pass over the pivoting pulleys 222, 224 and are ready for engagement by the user. As with the chest exercise apparatus 100, the distal end 52, 54 of each strand 28, 30 of the cable 22 may be fitted with a wide variety of grips known to those skilled in the art.

The pivoting pulleys 222, 224 are identical to those discussed above with reference to FIG. 4. In use, an individual will be seated on the seat facing the weight stack. The individual will then grip the handles at the distal end of each strand and push the handles upwardly to generate resistance from the weight stack. As shown in FIGS. 5 to 8, the flexibility provided by the pivoting pulleys permits the individual to move in a wide variety of paths in order to equally exercise a wide variety of shoulder muscles.

While it is disclosed above that the present shoulder exercise apparatus is designed to be used with the user sitting and facing the weight stack, the versatility provided by the design of the exercise apparatus provides users with virtually unlimited possibilities with regard to the range of exercise motions that may be accommodated by the present exercise apparatus.

Figure 8:
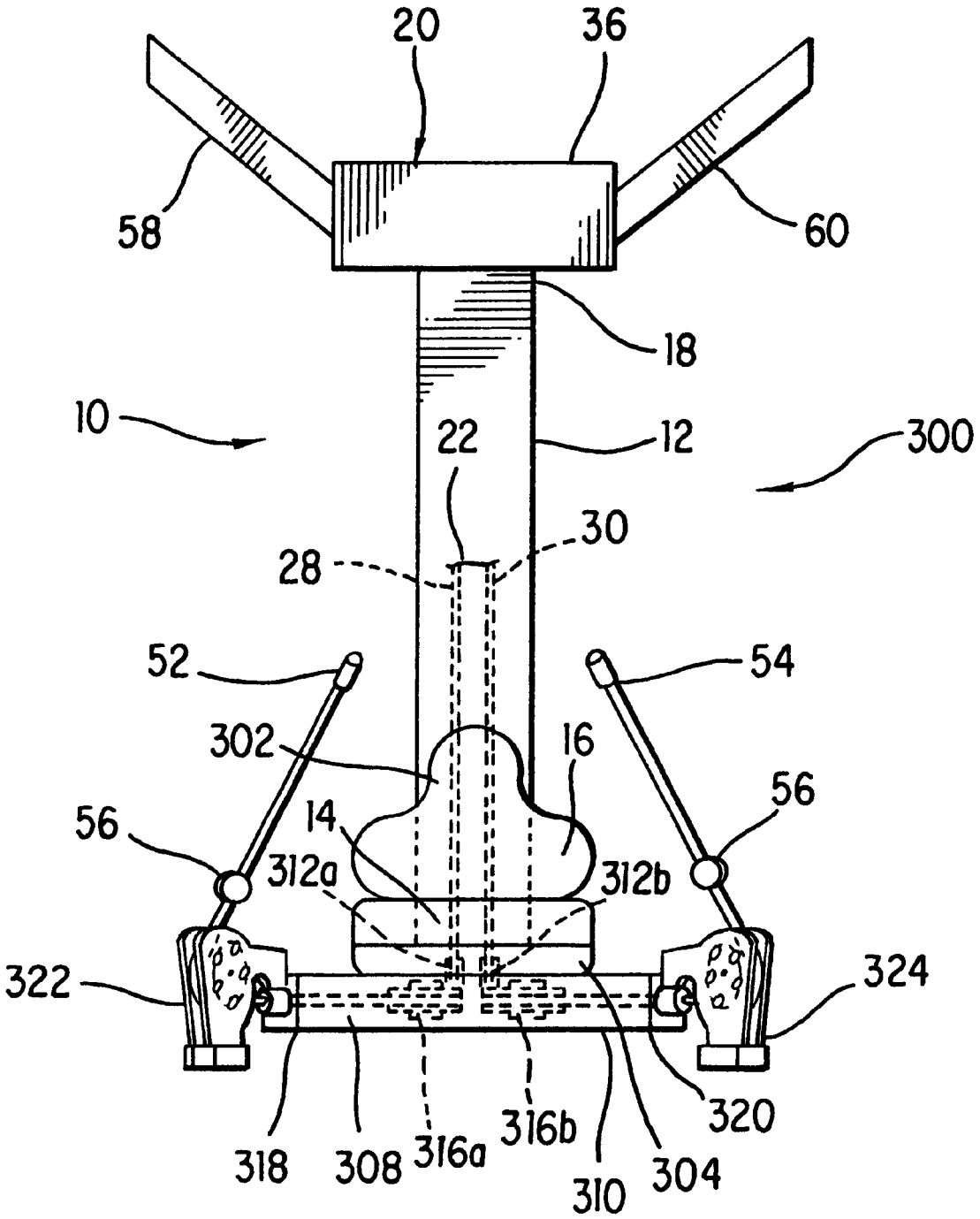
FIG. 8 is a top view of an abdominal exercise apparatus in accordance with the present invention.
Figure 10:
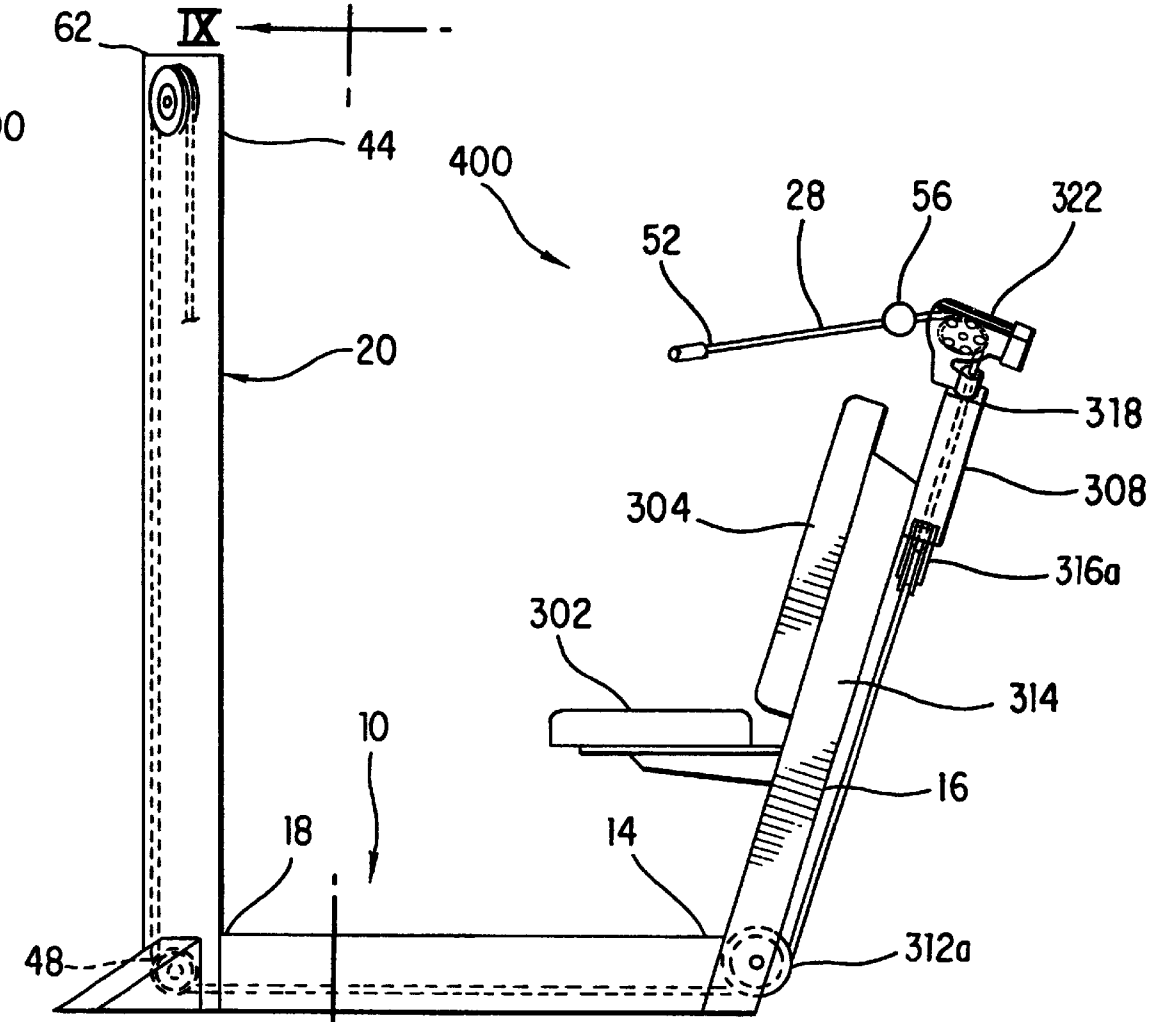
FIG. 10 is a side view of the abdominal exercise apparatus as shown in FIG. 8.
Figure 9:
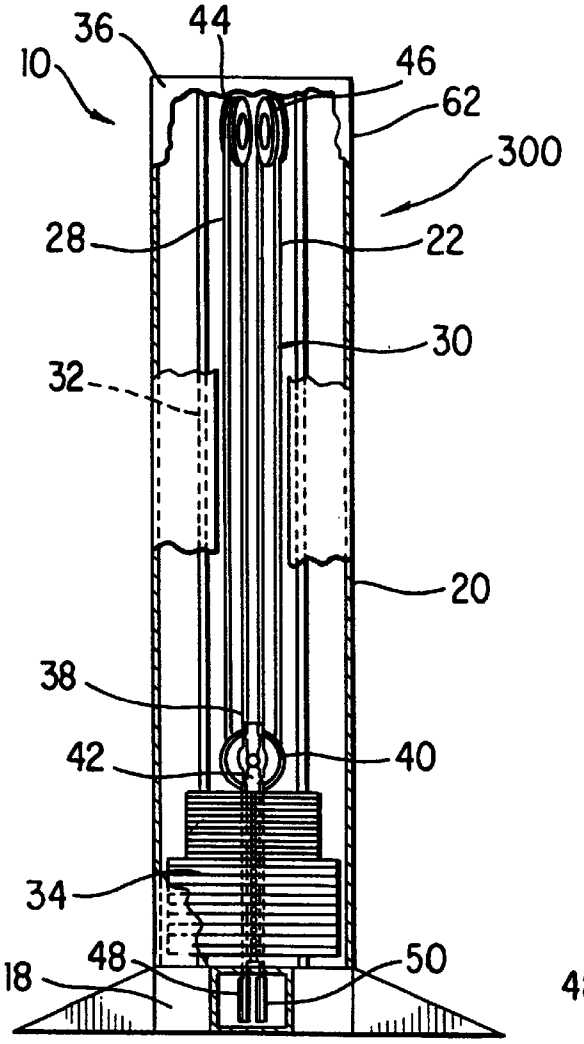
FIG. 9 is a cross sectional view of the abdominal exercise apparatus along the line IX—IX in FIG. 10.

With reference to FIGS. 8 to 10, an abdominal exercise apparatus 300 in accordance with the present invention is disclosed. The abdominal exercise apparatus 300 includes the base structure 10 discussed above. In order to accommodate the abdominal exercises being performed on the disclosed apparatus, the base structure 10 includes a user support structure 16 with an inclined backrest 304 similar to that disclosed with regard to the chest exercise apparatus 100. The backrest 304 provides the support necessary for performing abdominal exercises as an individual faces toward the weight stack 20 in accordance with the preferred embodiment of the present invention. While a specific seat 302 structure is disclosed in accordance with the present invention, other seat structures may be employed without departing from the spirit of the present invention.

As with the other exercise apparatuses, the single cable 22 coupled to the weight stack 20 extends from the weight stack 20 and through the center of the central support member 12 toward the first end 14 of the central support member 12. After exiting the first end 14 of the central support member 12, the respective strands 28, 30 of the cable 22 are guided along the back surface of a support column 314 of the seat 302 by a series of pulleys to first and second support sleeves 308, 310 extending from opposite sides of the seat backrest 304.

Specifically, the strands 28, 30 of the cable 22 are respectively guided by a first pair of pulleys 312*a*, 312*b* directing the cable 22 along the support column 314. The strands 28, 30 of the cable 22 are then guided by a pair of transversely oriented pulleys 316*a*, 316*b* into the first and second support sleeves 308, 310.

The first and second support sleeves 308, 310 extend upwardly and outwardly such that the distal end 318, 320 of each support sleeve 308, 310 terminates at a position approximately in line with the top portion of the seat backrest 304 and in line with the shoulders of an individual utilizing the present apparatus.

Specifically, and in accordance with the preferred embodiment of the present invention, the distal end 318, 320 of each support sleeve 308, 310 is positioned approximately 50 inches above the central support member 12 as the support sleeves 308, 310 respectively extend upwardly at and angle of 60° relative to a horizontal plane and rearwardly at an angle of 0° relative to a vertical plane.

First and second pivoting pulleys 322, 324 are respectively coupled to distal ends 318, 320 of the first and second support sleeves 308, 310. In this way, the strands 28, 30 of the cable 22 respectively exit the first and second support sleeves 308, 310 pass over the pivoting pulleys 322, 324 and are ready for engagement by the user. The distal end 52, 54 of each strand 28, 30 of the cable 22 may be fitted to a wide variety of grips known to those skilled in art. The pivoting pulleys are the same as those disclosed in FIG. 4.

In use, an individual will be seated on the seat facing the weight stack. The individual will then grip the handles at the distal ends at the respective ends of the cable, and push the handles toward the weight stack to generate resistance from the weight stack. As shown in FIGS. 8 to 10, the flexibility provided by the pivoting pulleys permits the individual to move in a wide variety of paths in order to equally exercise a wide variety of abdominal muscles.

While it is disclosed above that the present abdominal exercise apparatus is designed to be used with the user sitting and facing the weight stack, the versatility provided by the design of the exercise apparatus provides users with virtually unlimited possibilities with regard to the range of exercise motions that may be accommodated by the present exercise apparatus.

Figure 11:
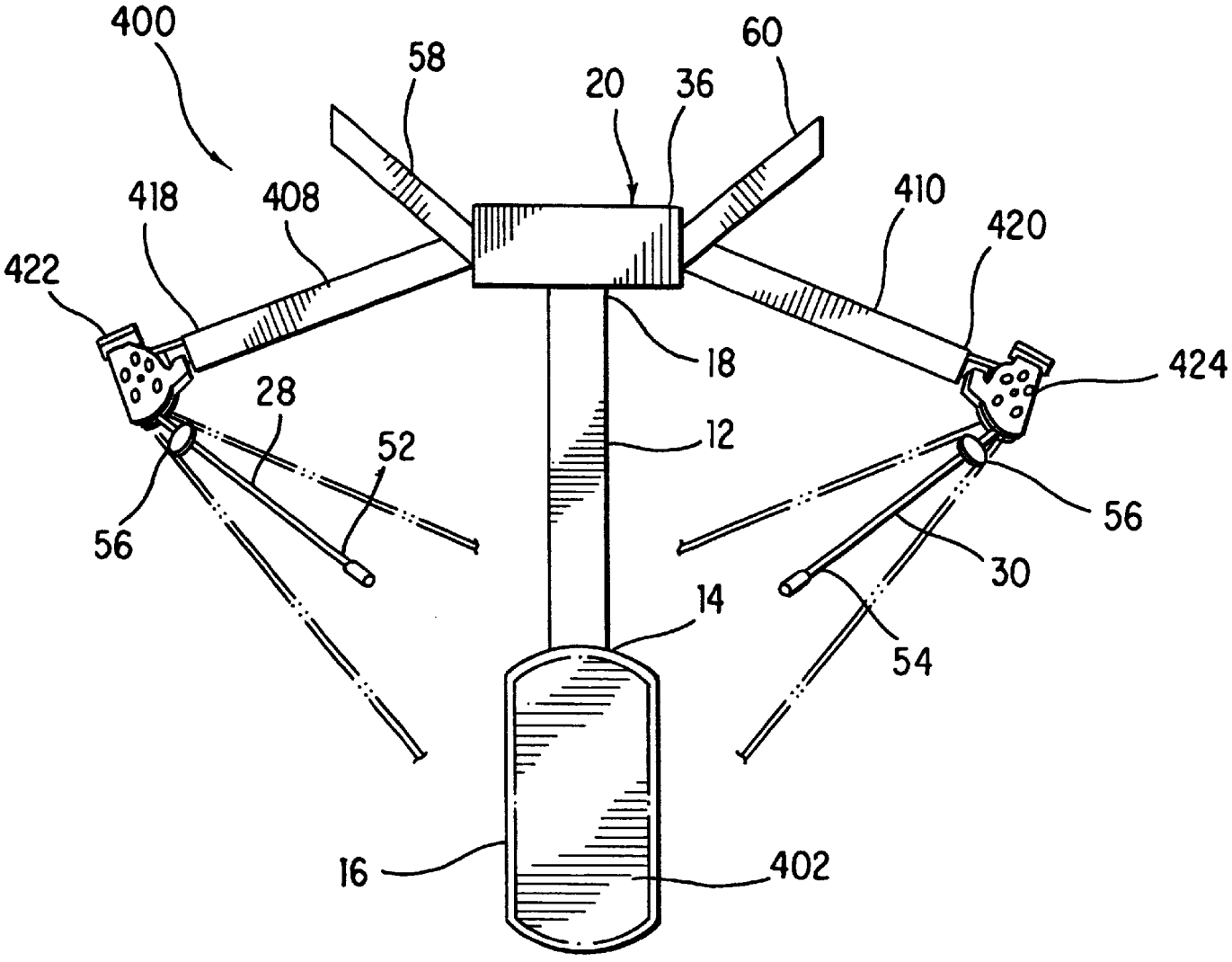
FIG. 11 is a top view of a biceps exercise apparatus in accordance with the present invention.
Figure 13:
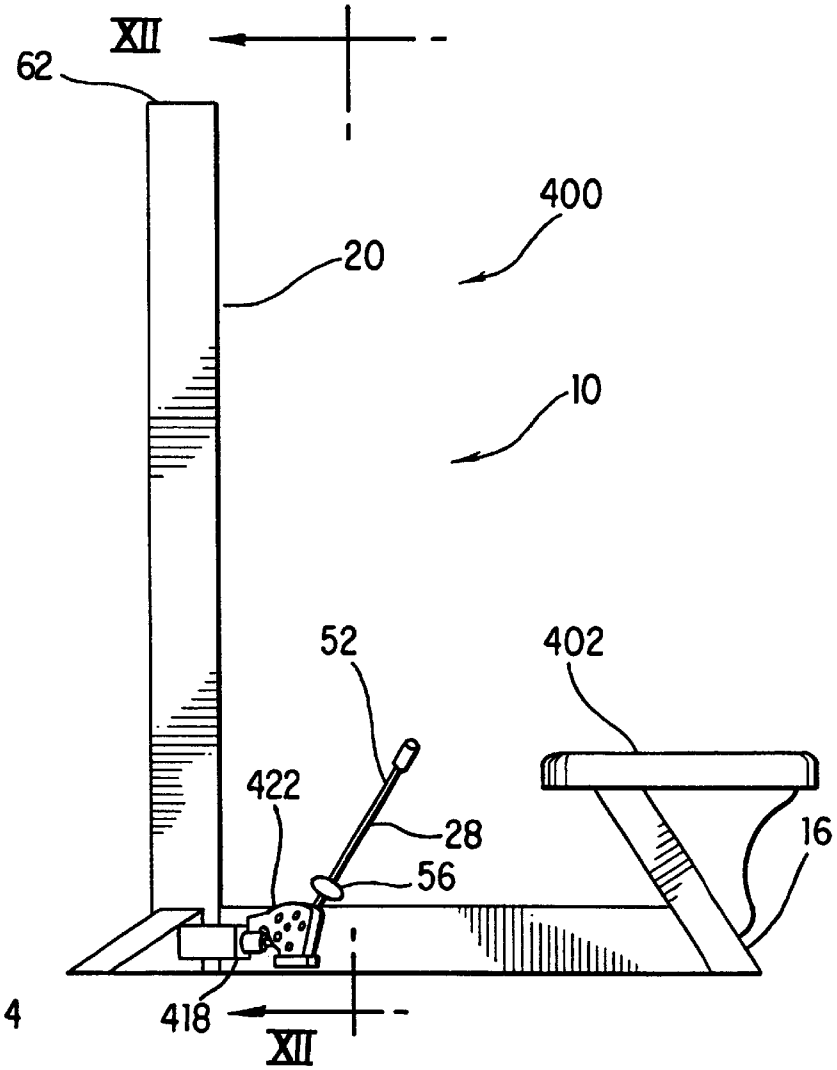
FIG. 13 is a side view of a biceps exercise apparatus as shown in FIG. 10.
Figure 12:
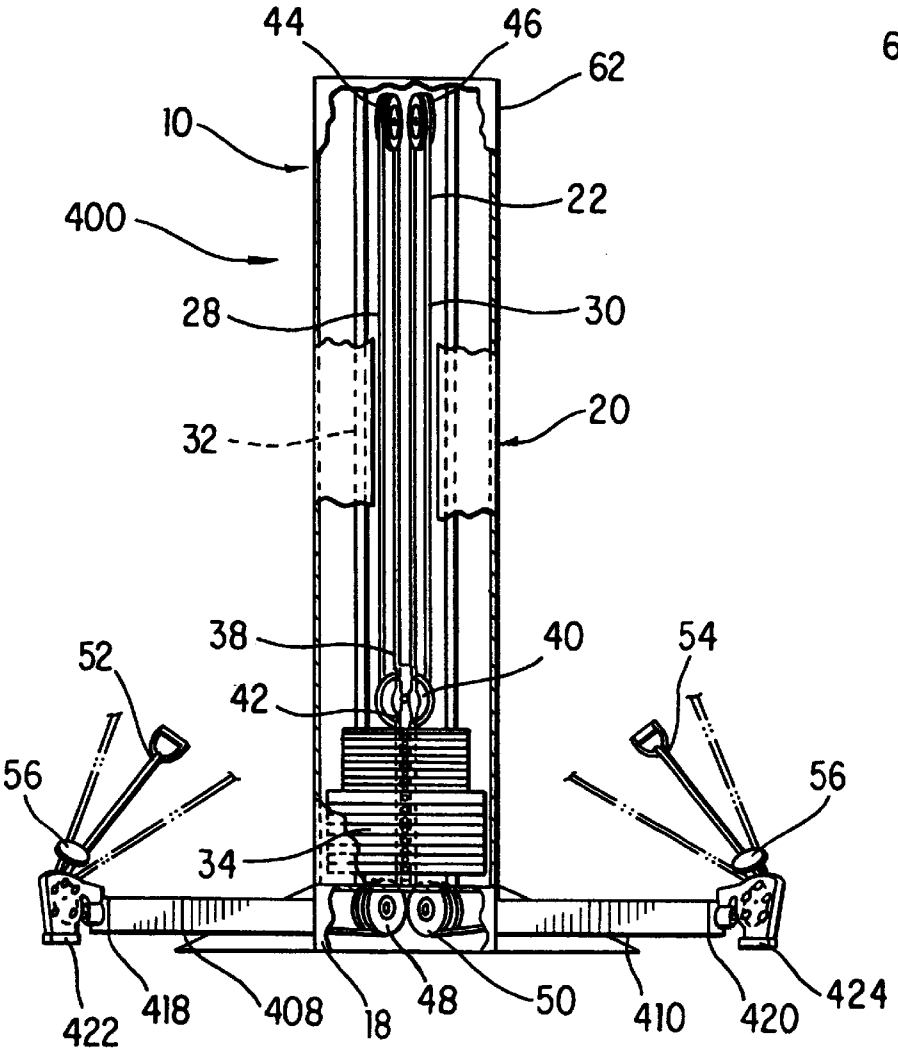
FIG. 12 is a cross sectional view of the biceps exercise along the line XII—XII in FIG. 13.

With reference to FIGS. 11 to 13, a biceps exercise apparatus 400 in accordance with present invention is disclosed. The biceps exercise apparatus 400 includes the base structure 10 discussed above. In contrast to the abdominal exercise machine 300, the shoulder exercise machine 200 and the chest exercise machine 100, the biceps exercise apparatus 400 includes a simple seat 402 for supporting an individual. The seat 402 structure does not include a backrest since individuals utilizing the biceps exercise apparatus 400 will not require back support during the exercise.

The single cable 22 coupled to the weight stack 20 extends from the weight stack 20 and through the first and second lower pulleys 48, 50 discussed above. The strands 28, 30 of the cable 22 do not extend through the central support member 12. Rather, the strands 28, 30 of the cable 22 extend into support sleeves 408, 410 directly secured at the second end 18 of the central support member 12.

The support sleeves 408, 410 extend outwardly from the longitudinal axis of the central support member 12 and slightly toward the first end 14 of the central support member 12. The distal end 418, 420 of each of the first and second sleeves 408, 410 terminates at a position substantially outside the shoulder width of an individual who might be utilizing the exercise apparatus.

Specifically, and in accordance with the preferred embodiment of the present invention, the distal ends 418, 420 of the first and second support sleeves 408, 410 tip up 5 inches from the ground while the support sleeves 408, 410 respectively extend rearwardly at an angle of 25° relative to a vertical plane for a distance of approximately 15 inches.

As with the prior exercise devices, first and second pivoting pulleys 422, 424 are respectively coupled to the distal ends 418, 422 of the first and second support sleeve 408, 410. In this way, the strands 28, 30 of the cable 22 respectively exit the first and second support sleeves 408, 410, pass over the pivoting pulleys 422, 424 and are ready for engagement by the user. The pivoting pulleys 422, 424 are shown in greater detail in FIG. 4, and are discussed above. The distal ends 52, 54 of each strand 28, 30 of the cable 22 may be fitted with a wide variety of grips known to those skilled in the art.

In use, an individual will be seated on the seat facing the weight stack. The individual will then grip the handles at the distal ends of the respective ends of the cable, and pull the handle toward himself or herself to generate resistance from the weight stack. As shown in FIGS. 10 to 13, the flexibility provided by the pivoting pulleys permits the individual to move in a wide variety of paths in order to equally exercise a wide variety of biceps muscles.

While it is disclosed above that the present biceps exercise apparatus is designed to be used with the user sitting and facing the weight stack, the versatility provided by the design of the exercise apparatus provides users with virtually unlimited possibilities with regard to the range of exercise motions that may be accommodated by the present exercise apparatus.

Figure 14:
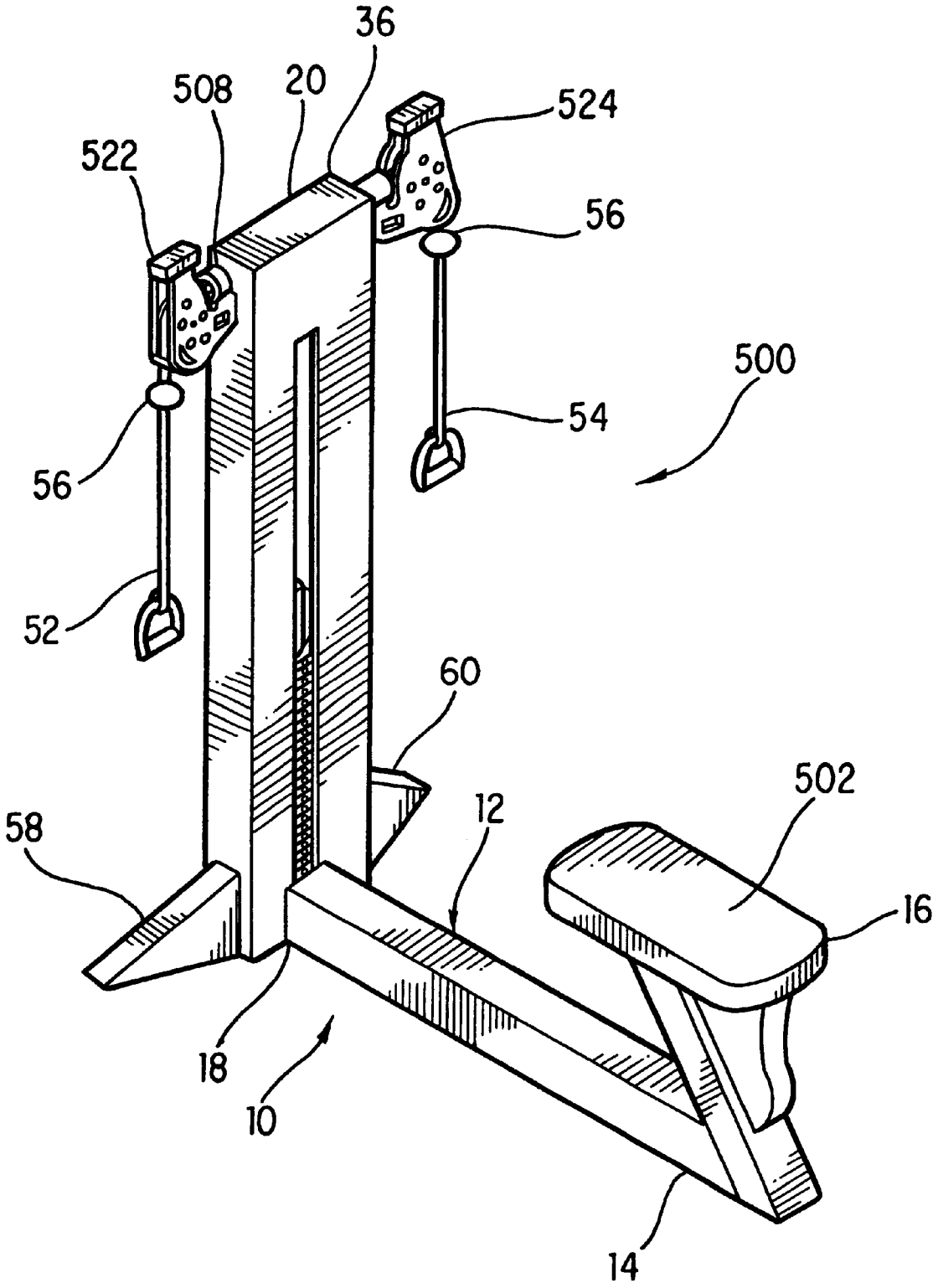
FIG. 14 is a perspective view of a triceps exercise apparatus in accordance with the present invention.
Figure 16:
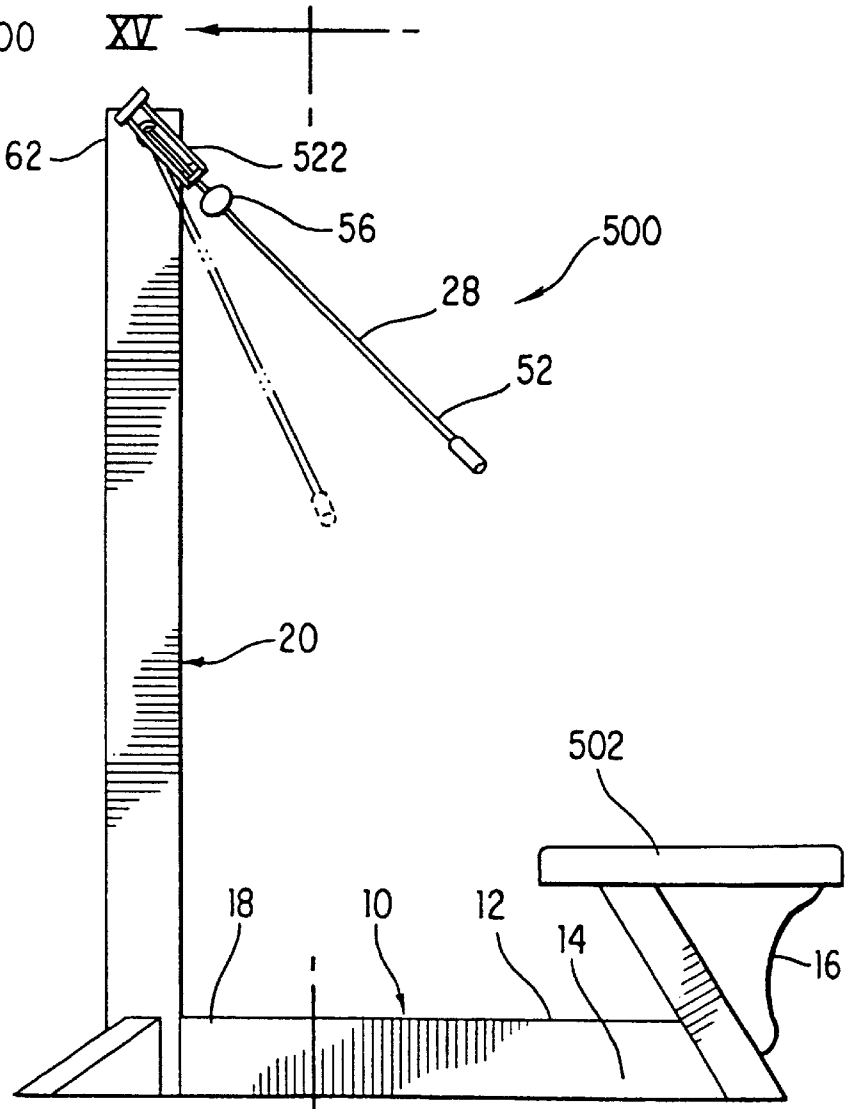
FIG. 16 is a side view of the triceps exercise apparatus as shown in FIG. 14.
Figure 15:
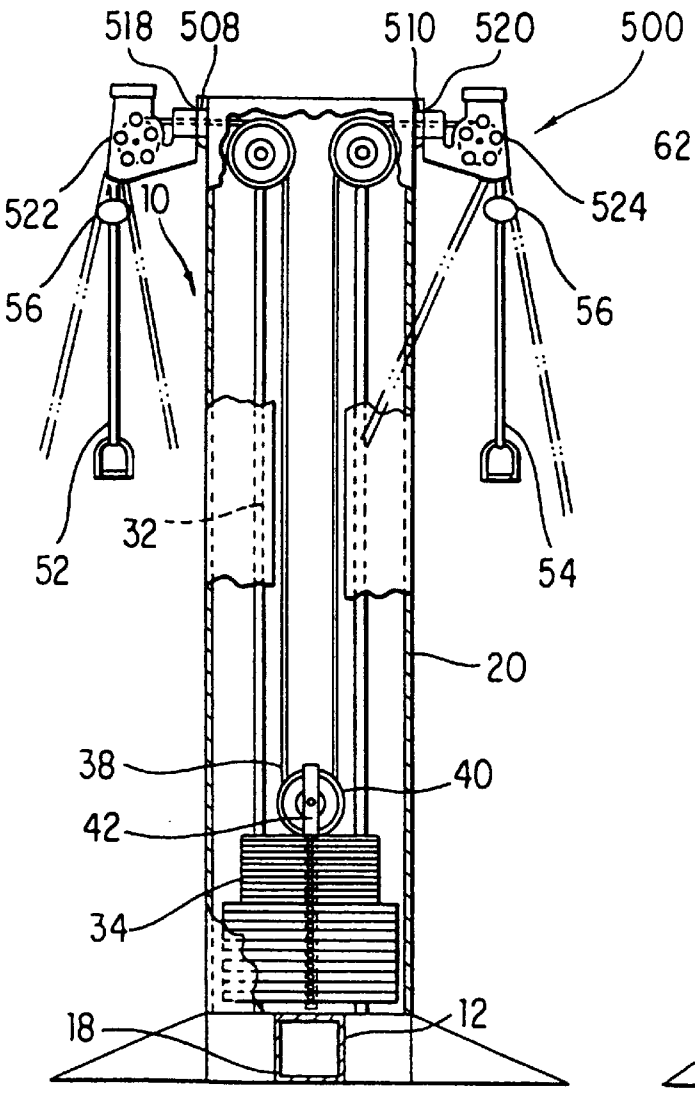
FIG. 15 is a cross section view of the triceps exercise apparatus along the line XV—XV in FIG. 16.
Figure 17:
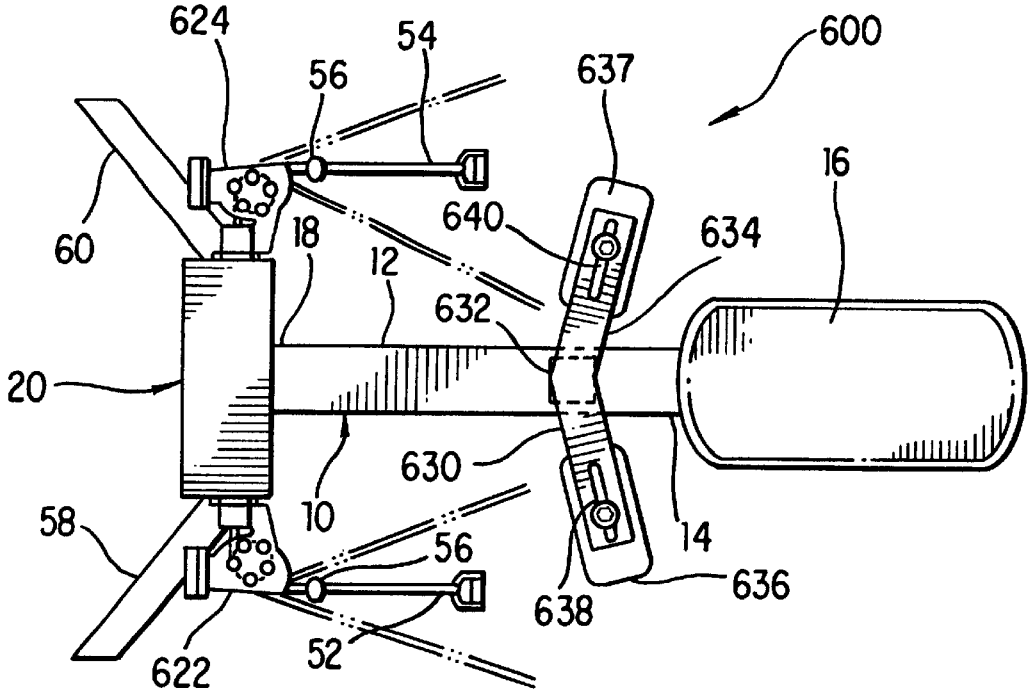
FIG. 17 is a top view of a rowing exercise apparatus is in accordance with the present invention.
Figure 20:
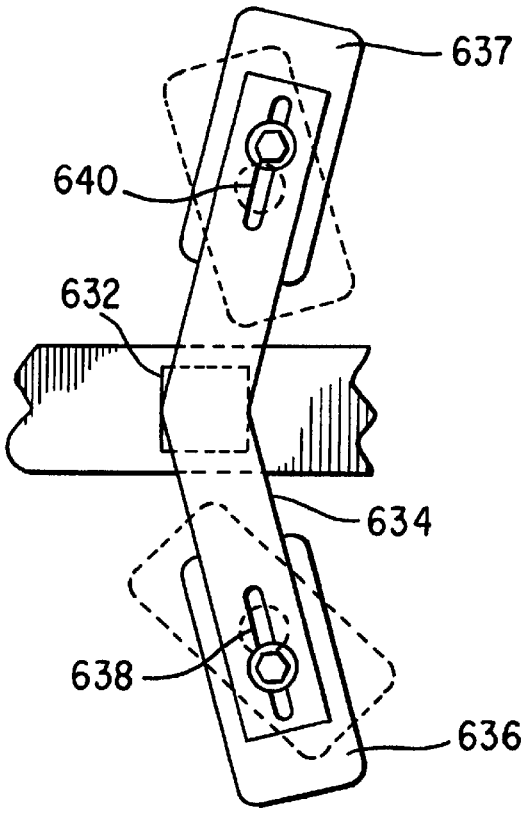
FIG. 20 is a detailed view of the leg support used in conjunction with the rowing exerciser apparatus.
Figure 19:
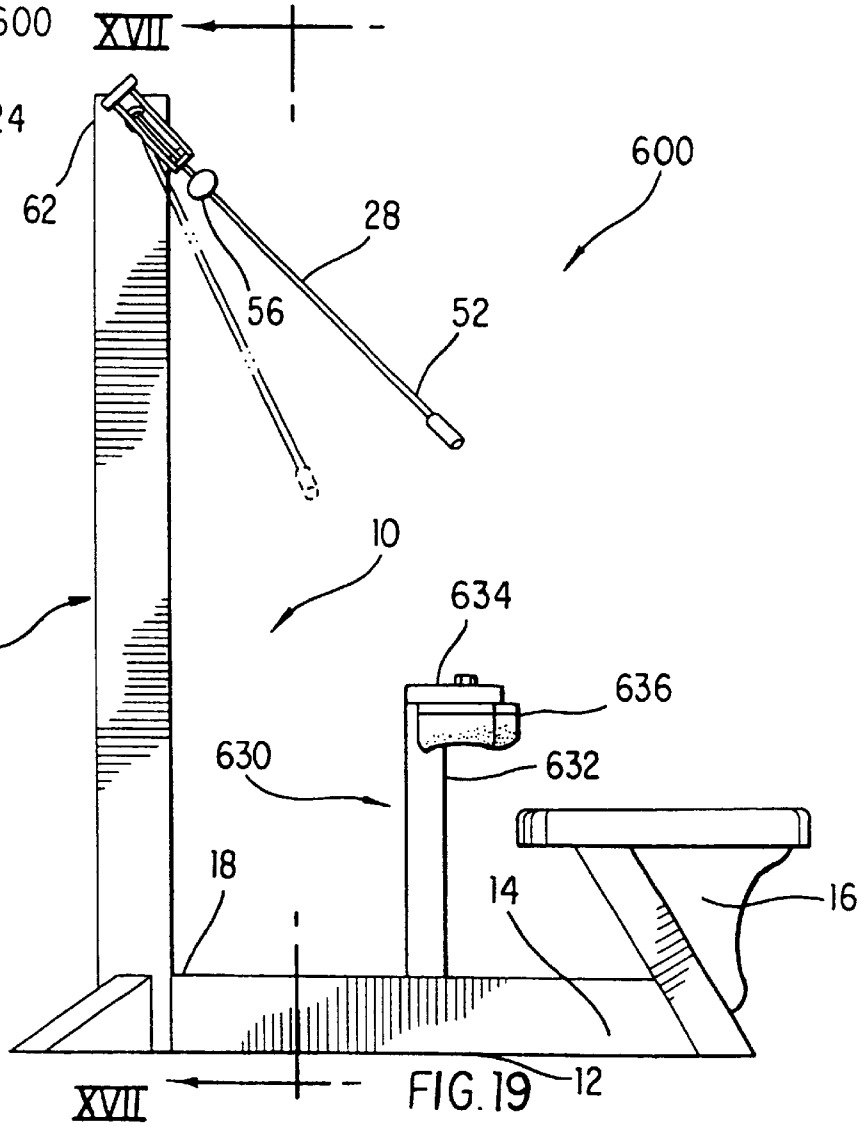
FIG. 19 is a side view of the rowing exercise apparatus as shown in FIG. 17.
Figure 18:
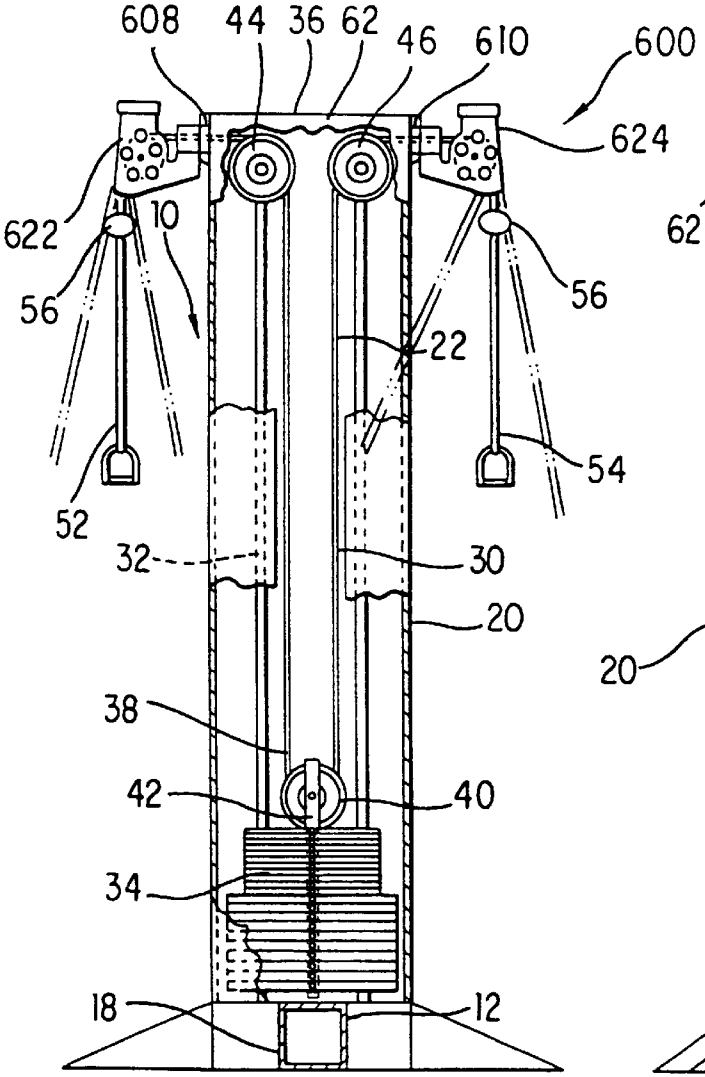
FIG. 18 is a cross sectional view of the rowing exercise apparatus along the line XVIII—XVIII in FIG. 19.

With reference to FIGS. 14 to 16, a triceps exercise apparatus 500 in accordance the present invention is disclosed. The triceps exercise apparatus 500 includes the base structure 10 discussed above. As with the biceps exercise apparatus 400, the triceps exercise apparatus 500 merely discloses a simple seat 502 for supporting a user. While a specific seat 502 structure is disclosed in accordance with the present invention, other seat structures may be employed without departing from the spirit of the present invention.

As briefly discussed, the single cable 22 coupled to the weight stack 20 does not extend through the first and second lower pulleys 48, 50 as in the exercise apparatuses discussed above. Rather, the strands 28, 30 of the cable 22 exit the first and second upper pulleys 44, 46 and move directly to first and second support sleeves 508, 510 secured at the upper end 62 of the weight stack 20.

The first and second support sleeves 508, 510 extend outwardly from the upper end 62 of the weight stack 20 such that the distal end 518, 520 of each of the first and second support sleeve 518, 520 terminates at a position approximately in line with the shoulders of an individual utilizing the present triceps exercise apparatus 500. Given that the support sleeves 508, 510 are secured at the upper end 62 of the weight stack 20, the distal end 518, 520 of each of the first and second support sleeve 508, 510 will be slightly above the shoulders, and probably head, of an individual utilizing the present exercise apparatus.

Specifically, and in accordance with the preferred embodiment of the present invention, the first and second support sleeves 508, 510 extend outwardly perpendicular to the longitudinal axis of the weight stack 20 and within the horizontal plane in which the weight stack 20 sits. The first and second support sleeves 508, 510 extend outwardly a distance of 25 inches.

First and second pivoting pulleys 522, 524 are respectively coupled to the distal ends 518, 520 of the first and second support sleeves 508, 510. In this way, the strands 28, 30 of the cable 22 respectively exit the first and second support sleeves 508, 510, pass over the pivoting pulleys 522, 524 and are ready for engagement by the user. The distal ends 52, 54 of each strand 28, 30 of the cable 22 may be fitted with a wide variety of grips known to those skilled in the art.

The pivoting pulleys 522, 524 are identical to those employed in the other exercise apparatuses and are shown in greater detail in FIG. 4. In use, the individual will be seated on the seat facing the weight stack. The individual will then grip the handles at the distal ends of the respective ends of the cable, and push the handles toward the ground to generate resistance from the weight stack. As shown in FIGS. 14 to 16, the flexibility provided by the pivoting pulleys permits the individual to move in a wide variety of paths in order to equally exercise a wide variety of triceps muscles.

While it is disclosed above that the present triceps exercise apparatus is designed to be used with the user sitting and facing the weight stack, the versatility provided by the design of the exercise apparatus provides users with virtually unlimited possibilities with regard to the range of exercise motions that may be accommodated by the present exercise apparatus.

With reference to FIGS. 17 to 20, a rowing exercise apparatus 600 in accordance with the present invention is disclosed. The rowing exercise apparatus 600 is substantially identical to the triceps exercise apparatus 500 and as such only the use of the device will be disclosed herein. However, the rowing exercise apparatus 600 is provided with a leg support 630 adjacent the user support 16. The leg support 630 includes an upwardly extending post 632 with a vertical bar 634 secured to its upper end. Pads 636, 637 are secured to the vertical bar and directed downwardly to engage the knees of an individual using the device. The pads 636, 637 are adjustably mounted within respective slots 638, 640 formed in the vertical bar 634. In this way, the pads 636, 637 may be adjusted to accommodate users of varying sizes.

In use, an individual will be seated on the seat facing the weight stack. The individual will then grip the handles at the distal ends of the respective ends of the cable, and pull the handles toward his or her chest to generate resistance from the weight stack. As shown in FIGS. 17 to 20, the flexibility provided by the pivoting pulleys permits the individual to move in a wide variety of paths in order to equally exercise a wide variety of muscles.

Figure 21:
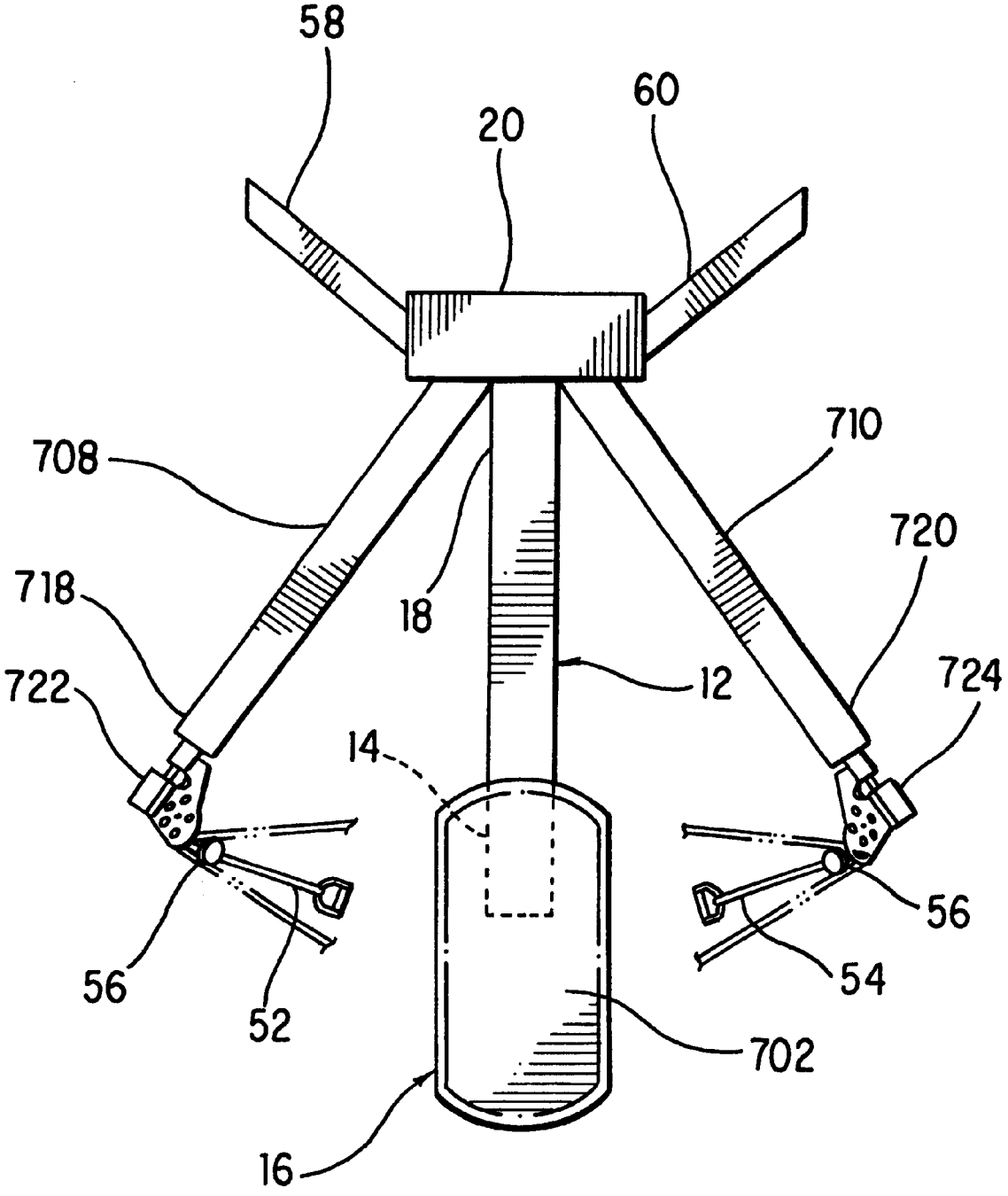
FIG. 21 is a top view of a lat exercise apparatus in accordance with the present invention.
Figure 23:
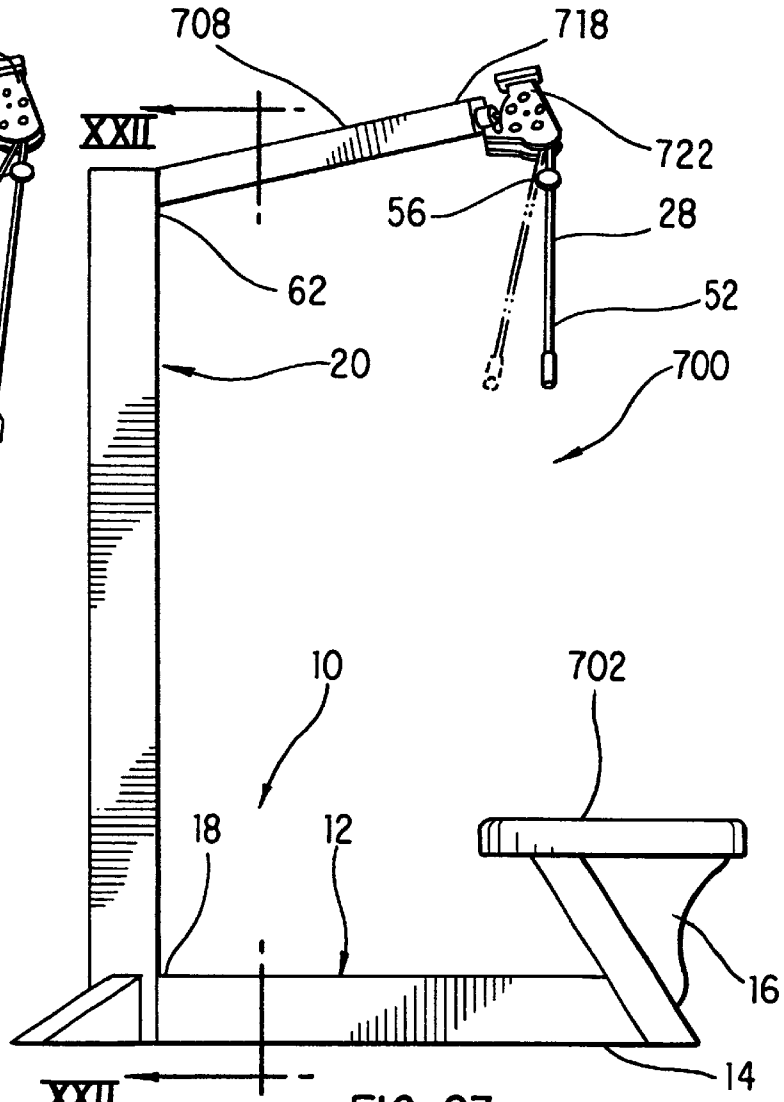
FIG. 23 is a side view of the lat exercise apparatus as shown in FIG. 22.
Figure 22:
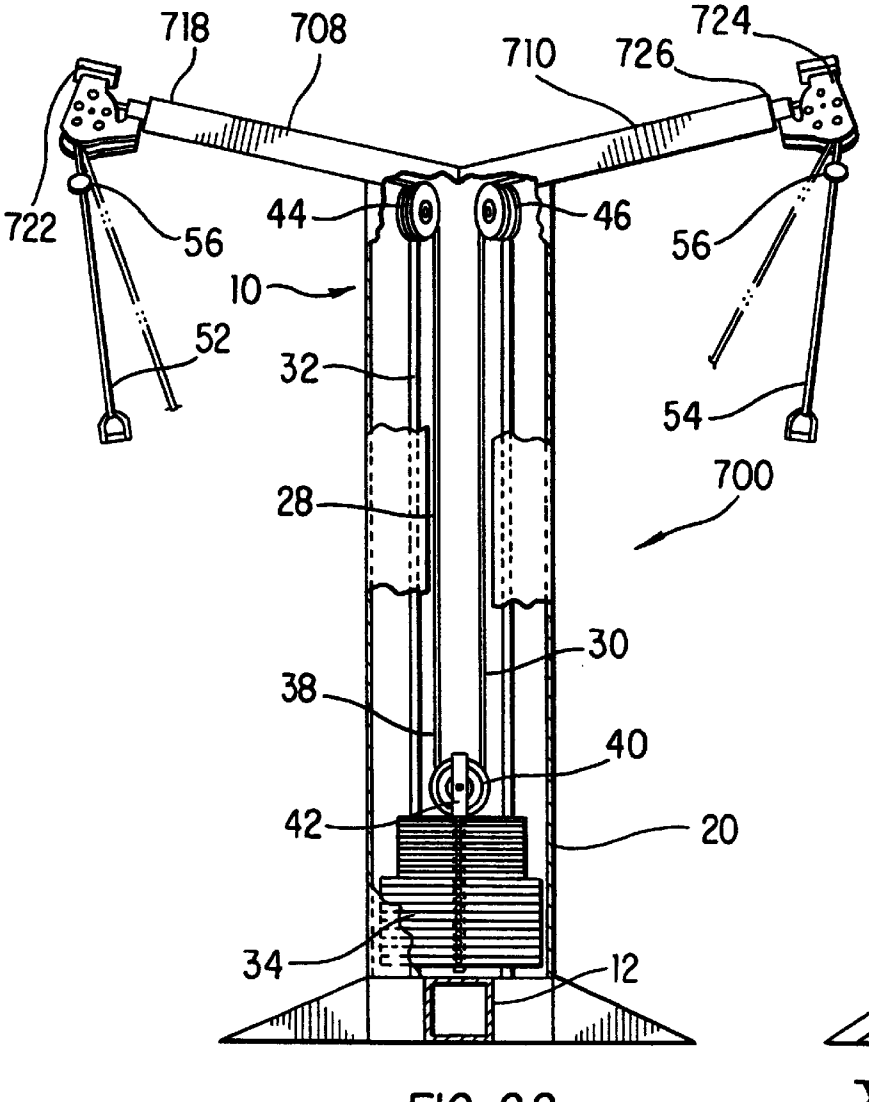
FIG. 22 is a cross sectional view of the lat exercise apparatus along the line XXII—XXII in FIG. 23.

With reference to FIGS. 21 to 23, a lat exercise apparatus 700 in accordance the present invention is disclosed. The lat exercise apparatus 700 includes the base structure 10 discussed above. As with the biceps exercise apparatus 400, the lat exercise apparatus 700 merely discloses a simple seat 702 for supporting a user. While a specific seat 702 structure is disclosed in accordance with the present invention, other seat structures may be employed without departing from the spirit of the present invention.

As briefly discussed, the single cable 22 coupled to the weight stack 20 does not extend through the first and second lower pulleys 48, 50 as in the exercise apparatuses discussed above. Rather, the strands 28, 30 of the cable 22 exit the first and second upper pulleys 44, 46 and move directly to first and second support sleeves 708, 710 secured at the upper end 62 of the weight stack 20.

The first and second support sleeve 708, 710 extend outwardly, upwardly and rearwardly from the upper end of the weight stack 20 such that the distal ends 718, 720 of each of the first and second support sleeves 708, 710 terminates at a position above the top of the weight stack 20 and the shoulders of an individual utilizing the present lat exercise apparatus 700.

Specifically, and in accordance with the preferred embodiment of the present invention, the distal ends 718, 720 of the first and second support sleeves 718, 720 are positioned approximately 80 inches above the central support member as the support sleeves respectively extend upwardly at an angle of 15° relative to a horizontal plane and rearwardly at an angle of 40° relative to a vertical plane.

First and second pivoting pulleys 722, 724 are respectively coupled to the distal ends 718, 720 of the first and second support sleeves 708, 710. In this way, the strands 28, 30 of the cable 22 respectively exit the first and second support sleeves 708, 710, pass over the pivoting pulleys 722, 724 and are ready for engagement by the user. The distal ends 52, 54 of each strand 28, 30 of the cable 22 may be fitted with a wide variety of grips known to those skilled in the art.

The pivoting pulleys 722, 724 are identical to those employed in the other exercise apparatuses and are shown in greater detail in FIG. 4. In use, the individual will be seated on the seat facing the weight stack. The individual will then grip the handles at the distal ends of the respective ends of the cable, and pull the handles toward his or her chest to generate resistance from the weight stack. As shown in FIGS. 22 to 24, the flexibility provided by the pivoting pulleys permits the individual to move in a wide variety of paths in order to equally exercise a wide variety of lat muscles.

While it is disclosed above that the present lat exercise apparatus is designed to be used with the user sitting and facing the weight stack, the versatility provided by the design of the exercise apparatus provides users with virtually unlimited possibilities with regard to the range of exercise motions that may be accommodated by the present exercise apparatus.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A family of single-use exercise apparatuses designed to target a variety of muscle groups, comprising:

a variety of distinct exercise apparatuses utilizing a substantially identical base structure, the base structure comprising:

a central support member having a first end to which a user support structure is secured, and a second end to which a weight stack is secured, wherein the weight stack is actuated by a cable secured thereto for movement by an individual using a distinct exercise apparatus and the user support structure includes a seat facing the weight stack and connected to the central support member by a central support pillar;

each distinct exercise apparatus further including first and second fixed lateral support sleeves secured directly to either side of the central support pillar for directing opposite strands of the cable to a predetermined position for engagement by the user.

2. The family of exercise apparatuses according to claim 1, wherein the central support member is a tubular member through which the cable passes to facilitate the adaptation of the base structure for targeting various body parts.

3. The family of exercise apparatuses according to claim 1, wherein the weight stack includes vertical support members aligning and supporting a stack of weight plates to be moved via a pulley system.

4. The family of exercise apparatuses according to claim 1, wherein the weight stack is actuated via a single cable.

5. The family of exercise apparatuses according to claim 4, wherein a central portion of the cable is passed through a first pulley directly coupled to the stack of weight plates and opposite strands of the cable then respectively extend over first and second upper pulleys before passing over first and second lower pulleys.

6. The family of exercise apparatuses according to claim 4, wherein a central portion of the cable is passed through a first pulley directly coupled to the stack of weight plates and opposite strands of the cable pass over upper pulleys before being positioned for engagement by the user.

7. The family of exercise apparatuses according to claim 1, wherein at least one distinct exercise apparatus includes first and second support sleeves positioned for exercising the chest of an individual.

8. The family of exercise apparatuses according to claim 1, wherein at least one distinct exercise apparatus includes first and second support sleeves positioned for exercising the abdominals of an individual.

9. An exercise apparatus, comprising:

a base structure including a central support member having a first end to which a user support structure is secured, and a second end to which a weight stack is secured, wherein the weight stack is actuated by a cable secured thereto for movement by an individual using the exercise apparatus and the user support structure includes a seat facing the weight stack and connected to the central support member by a central support pillar;

first and second fixed lateral support sleeves secured directly to either side of the central support pillar for directing opposite strands of the cable to a predetermined position for engagement by the user;

the central support member defining a passageway through which the cable passes before passing through the respective first and second lateral support sleeves to facilitate positioning of the opposite strands for engagement by a user.

10. The exercise apparatus according to claim 9, the weight stack includes vertical support members aligning and supporting a stack of weight plates to be moved via a pulley system.

11. The exercise apparatus according to claim 9, wherein the weight stack is actuated via a single cable.

12. The exercise apparatus according to claim 11, wherein a central portion of the cable is passed through a first pulley directly coupled to the stack of weight plates and opposite strands of the cable then respectively extend over first and second upper pulleys before passing over first and second lower pulleys.

13. The exercise apparatus according to claim 11, wherein a central portion of the cable is passed through a first pulley directly coupled to the stack of weight plates and opposite strands of the cable pass over upper pulleys before being positioned for engagement by the user.

14. The exercise apparatus according to claim 9, wherein the first and second support sleeves are positioned for exercising the chest of an individual.

15. The exercise apparatus according to claim 9, wherein the first and second support sleeves are positioned for exercising the abdominals of an individual.

16. A method for manufacturing a family of single-use exercise apparatuses designed to target a variety of muscle groups, comprising the following steps:

creating a base structure dimensioned for use in the development of a variety of distinct exercise apparatuses designed to target different muscle groups, the base structure including a central support member having a first end to which a user support structure is secured, and a second end to which a weight stack is secured, wherein the weight stack is actuated by a cable secured thereto for movement by an individual using a distinct exercise apparatus and the user support structure includes a seat facing the weight stack and connected to the central support member by a central support pillar;

selectively securing first and second lateral fixed support sleeves directly to either side of the central support pillar at distinct positions for directing opposite strands of the cable to a predetermined position for engagement by the user to perform various exercises targeting different muscle groups.

17. The method according to claim 16, wherein the central support member is a tubular member through which the cable passes to facilitate the adaptation of the base structure for targeting various body parts.

18. The method according to claim 16, wherein the first and second support sleeves are positioned for exercising the chest of an individual.

19. The method according to claim 16, wherein the first and second support sleeves are positioned for exercising the abdominals of an individual.

20. The method according to claim 16, wherein the weight stack is actuated via a single cable.

21. The method according to claim 20, wherein a central portion of the cable is passed through a first pulley directly coupled to the stack of weight plates and opposite strands of the cable then respectively extend over first and second upper pulleys before passing over first and second lower pulleys.

22. The method according to claim 20, wherein a central portion of the cable is passed through a first pulley directly coupled to the stack of weight plates and opposite strands of the cable pass over upper pulleys before being positioned for engagement by the user.

* * * * *

UNITED STATES PATENT AND TRADEMARK OFFICE

CERTIFICATE OF CORRECTION

PATENT NO. : 6,387,020 B1
DATED : May 14, 2002
INVENTOR(S) : Roy Simonson

It is certified that error appears in the above-identified patent and that said Letters Patent is hereby corrected as shown below:

Column 5,
Line 21, after "discussed" delete "in"

Column 6,
Line 15, after "cable" insert -- 22 --

Column 9,
Line 14, after "with" insert -- the --

Signed and Sealed this

Ninth Day of September, 2003

JAMES E. ROGAN
*Director of the United States Patent and Trademark Office*